US005282549A

United States Patent [19]

Scholz et al.

[11] Patent Number: 5,282,549

[45] Date of Patent: Feb. 1, 1994

[54] DISPENSER WITH AN ENERGY STORAGE MEMBER AND AN OVERLOAD PREVENTION MECHANISM

[75] Inventors: Michael P. Scholz, San Clemente; Joe J. Lones, San Diego, both of Calif.

[73] Assignee: Williams Dispenser Corporation, Los Angeles, Calif.

[21] Appl. No.: 851,804

[22] Filed: Mar. 16, 1992

[51] Int. Cl.[5] ..... B65D 35/28

[52] U.S. Cl. ..... 222/95; 222/105; 222/326; 222/386.5; 222/390

[58] Field of Search ..... 222/95, 105, 326, 336, 222/386, 386.5, 390

[56] References Cited

U.S. PATENT DOCUMENTS

| | | | |
|---|---|---|---|
| 2,477,875 | 8/1949 | Hutchason | 222/95 |
| 3,195,168 | 7/1965 | Roberts | 401/4 |
| 3,561,644 | 2/1971 | Works | 222/95 |
| 3,815,787 | 1/1973 | Spies | 222/95 |
| 4,193,513 | 4/1977 | Bull, Jr. | 222/105 X |
| 4,293,353 | 10/1981 | Pelton et al. | 222/95 |
| 4,429,811 | 2/1984 | Bakeman | 222/390 |
| 4,899,910 | 2/1990 | Tabei et al. | 222/336 |
| 4,991,742 | 2/1991 | Chang | 222/95 |
| 5,042,696 | 8/1991 | Williams | 222/390 X |
| 5,139,178 | 8/1992 | Arch et al. | 222/326 |
| 5,143,259 | 9/1992 | Williams | 222/390 X |
| 5,174,473 | 12/1992 | Mavelli | 222/38 |
| 5,186,361 | 2/1993 | Williams | 222/95 |

FOREIGN PATENT DOCUMENTS

| | | | |
|---|---|---|---|
| 3618399 | 12/1987 | Fed. Rep. of Germany | 222/105 |
| 3832938 | 3/1990 | Fed. Rep. of Germany | 222/95 |
| 203567 | 6/1939 | Switzerland | 222/105 |

OTHER PUBLICATIONS

Article: "Urethane Replaces Rubber to Soften Ride", Machine Design Jun. 7, 1990, vol. 62, No. 12 (p. 68).

*Primary Examiner*—Andres Kashnikow
*Assistant Examiner*—Kenneth Bomberg
*Attorney, Agent, or Firm*—Burns, Doane, Swecker & Mathis

[57] ABSTRACT

A dispenser comprises a housing, a product-containing bag disposed within the housing, and a valve for discharging product from the bag. An energy-storing member, in the form of a gas-filled bellows, or a cellular foam element, is disposed beneath the product-containing bag and is raisable thereagainst to pressurize the product within the bag. An overload preventing mechanism prevents energy-storing member from being excessively compressed. The valve and product-containing bag are removable as a unit f. ,m the housing to enable an identical refill unit to be installed.

25 Claims, 4 Drawing Sheets

DISPENSER WITH AN ENERGY STORAGE MEMBER AND AN OVERLOAD PREVENTION MECHANISM

BACKGROUND OF THE INVENTION

The present invention relates to a dispenser, especially a hand-held spray dispenser in which a spray is emitted upon manual actuation of a valve.

For many years spray dispensers for dispensing products such as hair spray, deodorants, room air fresheners, etc., have utilized a container in which the product is stored in liquid form. A propellant gas under pressure occupies a head space between the top of the container and the liquid product. A dip tube extends downwardly through the propellant and product from a discharge valve located at the top of the container. When a user opens the discharge valve, the propellant pushes the liquid product into the bottom of the dip tube and then upwardly through the dip tube to the valve.

Propellant gases which have commonly been used have included butane and pentane, for example. Those gases feature the ability to become dissolved within the liquid product under the usual pressure conditions occurring within the container. Hence, the product is discharged in the form of liquid particles mixed with bubbles of the propellant gas. When exposed to the lower atmospheric pressure, those bubbles expand suddenly to advantageously break up the liquid particles into a finer spray pattern.

In some cases, the valve is configured to mix additional propellant gas directly from the head space to the product during discharge in order to create yet a finer spray pattern.

The conventional propellant gases have exhibited ideal product-expelling characteristics, i.e., an essentially constant pressure of a specified magnitude which can be maintained continuously for a specified duration of time.

More recently, however, due to concerns about environmental pollution, conventional propellant gases have fallen into disfavor. Alternative sources of propulsion have been sought which will satisfy the above-mentioned product-expelling characteristics without being accompanied by the discharge of polluting gases.

Dispensers have heretofore been proposed which employ an internal energy-storing member capable of being mechanically compressed by a rotatable actuator to pressurize a liquid product, e.g., see U.S. Pat. No. 3,195,168 which proposes to use an energy-storing member in the form of a coil spring. However, coil springs are not ideally suited to continuously produce a constant pressure for a sufficiently long duration to satisfy most spraying requirements.

In Williams U.S. Pat. No. 5,042,696 a multipiece piston is disclosed which comprises a product ejecting member and an energizing member separated by a gas-filled space. The energizing member is raisable by rotation of an outer sleeve to compress the gas while pressurizing the product, which is located above the ejecting member. The compressed gas acts as a gas spring to store energy. That energy is gradually released to eject the product when a discharge valve is opened by a user. Once the gas pressure has been dissipated, the outer sleeve is rotated to recompress the gas. This mechanism has been shown to provide a generally uniform pressure which can be maintained continuously at a sufficiently high magnitude for a suitable duration. However, in certain instances there exists a tendency for the gas to migrate through the container wall (especially if the wall is formed of certain plastics), thereby shortening the shelf-life of the dispenser. In such instances, it would be necessary to enclose the air within a collapsible bellows, but the possibility of leakage and resultant pressure loss might still exist.

It would, therefore, be desirable to provide a dispenser with an energy storing mechanism able to produce an essentially constant pressure that can be maintained continuously at a sufficiently high magnitude for a suitable duration, and which exhibits an ample shelf life.

It would also be desirable to ensure that a user of a dispenser having a manually actuable energy-storing member cannot accidentally over-pressurize that member.

Furthermore, it would be desirable to minimize the amount of disposable waste created when a dispenser has been emptied of its product.

SUMMARY OF THE INVENTION

The present invention relates to a dispenser comprising a housing, a manually operable outlet valve and a longitudinal end of the housing, and a flexible product-containing member disposed beneath the valve such that an interior of the product-containing member communicates with the valve. An elastically flexible energy-storing member is disposed beneath the product-containing member. A portion of the housing is manually rotatable. An energizing member is disposed beneath the energy-storing member and is operably connected with the rotatable portion of the housing to be raised in response to rotation of the rotatable portion for compressing the energy-storing member and pressurizing the product-containing member. The energy-storing member is expandable to expel product-containing member when the valve is open, and is recompressible by the manually rotatable member.

In one aspect of the invention, the energy-storing member comprises a closed-cell foam element. Preferably, the foam element comprises a closed-cell urethane foam element of generally cylindrical shape and having a slightly concave side wall.

In another aspect of the invention, the dispenser includes an overload preventing mechanism for preventing the energy-storing member from being compressed beyond a predetermined amount. The container may comprise separate upper and lower portions, with the overload prevention mechanism comprising a releasable tooth connection between those container portions. Alternatively, the housing may comprise upper and lower sleeve members which are relatively rotatable, and wherein the overload prevention mechanism comprises a releasable connection between the container and the upper sleeve member.

In yet another aspect of the present invention, the outlet valve and the product-containing member are removable as a unit from the housing in order to enable a refill unit comprised of the outlet valve and the product-containing member to be installed.

BRIEF DESCRIPTION OF THE DRAWINGS

The objects and advantages of the invention will become apparent from the following detailed description of a preferred embodiment thereof in connection with the accompanying drawings in which like numerals designate like elements, and in which.

DETAILED DESCRIPTION OF PREFERRED EMBODIMENTS OF THE INVENTION

Figure 1:
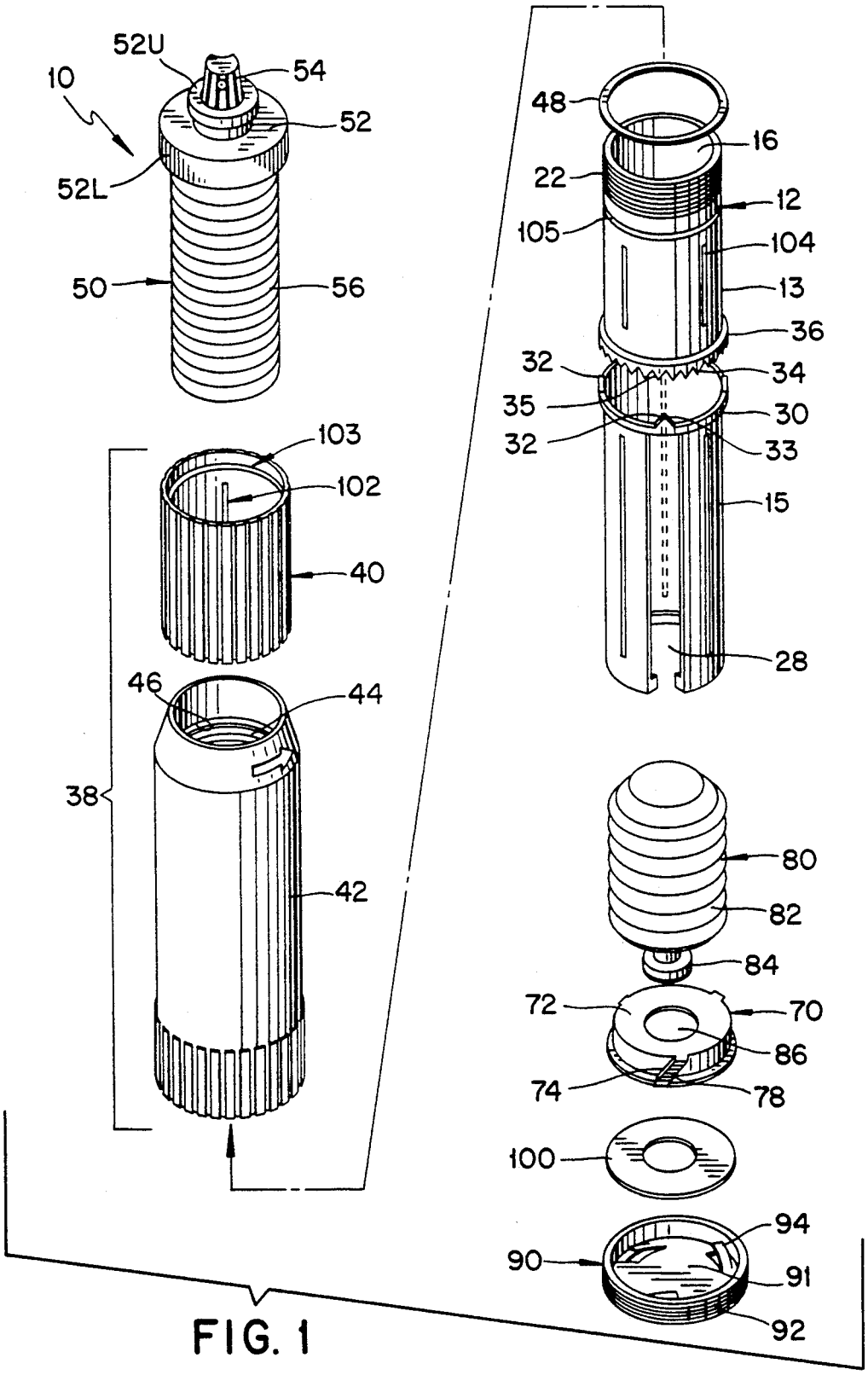
FIG. 1 is an exploded perspective view of a dispenser according to the present invention having a first embodiment of an energy-storing structure and a first embodiment of an overload prevention mechanism.
Figure 2:
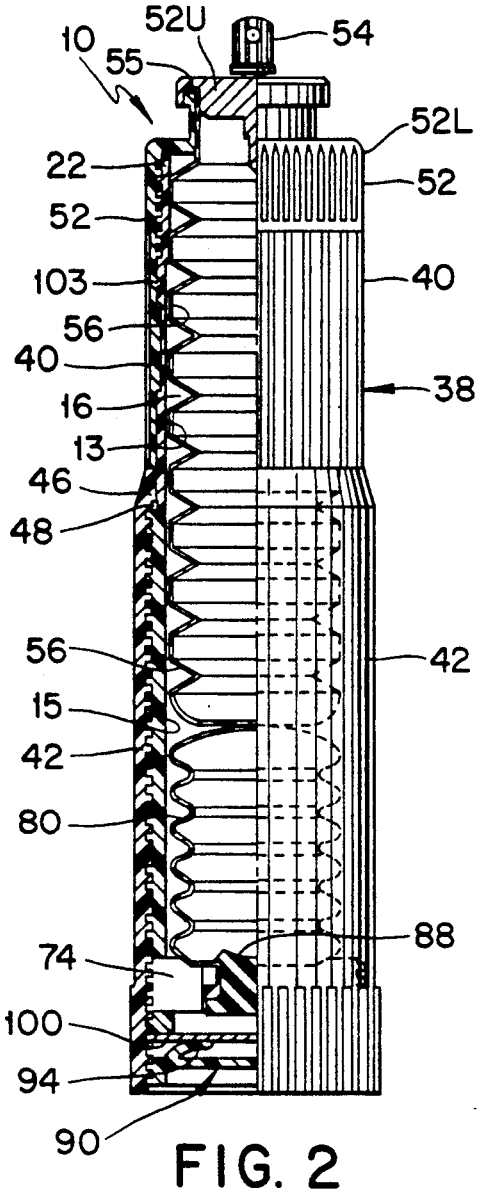
FIG. 2 is a side elevational view of the dispenser depicted in FIG. 1, with the components thereof being assembled, and with one side of the dispenser being shown in vertical cross-section.

As depicted in FIGS. 1 and 2, a spray dispenser 10 comprises a container 12 formed of upper and lower portions 13, 15. Those portions together form an inner compartment 16 which is open at its upper and lower ends. An upper end of the upper container portion 13 includes an externally threaded neck 22.

Projecting longitudinally upwardly through a cylindrical wall of the lower container portion 15 are three circumferentially spaced slots 28 which are spaced equidistantly around the circumference of the container, i.e., the slots are spaced apart by 120° (only one slot being depicted). Each slot 28 terminates upwardly adjacent to a circumferential upper rim 30 of the lower container portion 15. That rim carries a plurality of upwardly projecting circumferentially spaced teeth 32 which mesh with a plurality of circumferentially spaced teeth 34 projecting downwardly from a circumferential lower rim 36 formed at the lower end of the upper container portion 13. The teeth 32 include inclined faces 33 which bear against correspondingly inclined faces 35 of the teeth 34.

Mounted telescopingly over the outer periphery of the container 12 is a housing 38 which comprises upper and lower sleeve portions 40, 42. The sleeve portions 40, 42 overlie the container portions 13, 15, respectively. The sleeve lower portion 42 is of generally cylindrical shape and includes an internal helical threading 44.

The upper end of the sleeve lower portion 42 includes a radially inwardly projecting flange 46 which overlies the rim 36 of the upper container portion 13. A thrust ring 48 is interposed between that flange 46 and rim 36.

Attached to the threaded neck 22 of the upper container portion 13 is a product assembly 50 which comprises a cap 52 having internal threading for connection with the external threading of the neck 22 (see FIG. 2). The cap carries a conventional manually actuable discharge valve 54. Depending from the cap 52 is a product bag 56 formed of a flexible material in which a liquid product is carried. When the cap 52 is screwed onto the neck 22, the bag 56 is disposed within the chamber 16. The bag 56 may be constructed of a bellows configuration of the type disclosed in commonly as signed U.S. Ser. No. 07/717,661 filed Jun. 19, 1991, Pat. No. 5,238,150. By unscrewing the cap 52, the product assembly can be and replaced by an identical full product assembly. In particular, the top cap 52 includes upper and lower portions 52U, 52L which are fixedly attached together at their outer peripheral edges, with an upper peripheral edge 55 of the bag 56 being sandwiched therebetween. That edge 55 forms a permanently open upper opening of the bag, the opening being arranged coaxially with the container portion 13.

Slidably mounted within the container is a piston 70. As will be explained, rotation of the sleeve lower portion 42 relative to the container 12 causes the piston 70 to travel longitudinally upwardly within the container 12.

The piston 70 comprises a cylindrical disc 72 having a plurality of radially projecting lugs 74. The number and mutual spacing of the lugs 74 corresponds to the number of slots 28 in the lower container portion 15 (in this case, three lugs). Each lug is dimensioned so as to be projected radially beyond its respective slot 28 and to be vertically slidable in that slot. A radially outwardly directed face of each lug includes grooves 78 which are configured to define segments of a helical screw threading which mates with the inner helical screw thread 44 of the sleeve lower portion 42.

The piston 70 can be inserted upwardly into the open lower end of the lower container portion 15, and then mated with the screw thread 44 of the sleeve lower portion 42 in response to relative rotation between the container 12 and the sleeve lower portion 42 in a given direction.

Since the piston 70 cannot rotate relative to the container 12 (by virtue of the presence of the lugs 74 within the slots 28), rotation of the sleeve lower portion 42 relative to the container 12 will cause the piston to travel longitudinally upwardly within the container.

Disposed above the piston 70 is an energy storing member 80 which includes a bellows 82 that is elastically longitudinally compressible. The bellows 82 contains a compressible gas, such as nitrogen or air for example, and is sealed, whereby the extent by which bellows 82 can be collapsed is a function of the compressibility of the gas. Collapsing of the bellows 82 occurs when the piston 70 is raised, as the bellows 82 will be compressed between the product-containing bag 56 and the piston 70, as explained in the above-mentioned U.S. Ser. No. 07/727,661.

Thus, the rising motion of the piston 70 will cause the bellows 82 to be compressed, thereby storing energy (compressed gas) therein. As the bellows attempts to expand, it pressurizes the product within the bag 56. When the valve 54 is opened, the pressurized product will be expelled, until the bellows 82 becomes fully expanded so as to deplete its stored energy. This may occur as the result of a prolonged valve-opening duration, or numerous short valve-opening durations.

Projecting downwardly from the bellows 82 is a collar 84 which fits into a central opening 86 of the piston 70. The collar 84 carries a grommet 88 (see FIG.

2) which is formed of an elastomeric material such as rubber. Gas can be introduced into the bellows 82 (in order to charge that bellows) subsequent to assembly of the dispenser by means of a needle which is inserted through the grommet 88. When the needle is withdrawn, the grommet will self-seal.

Mounted at the bottom of the sleeve lower portion 42 is a biasing member in the form of a lower cap 90. The biasing member comprises a disk 91 having an external threading 92 mating with the internal thread 44 of the lower sleeve portion 42. A plurality of spring fingers 94 project upwardly from a top surface of the disk 91. A spacer 100 is disposed between the spring fingers 94 and the bottom end of the lower container portion 15. The spring fingers 94 act through the spacer 100 to yieldably push the teeth 32 of the lower container portion 15 longitudinally upwardly against the teeth 34 of the upper container portion 13. As will be explained, the spring fingers 94 are yieldable to enable those teeth 32, 34 to disengage from one another in order to prevent the bag 56 and bellows 82 from being excessively pressurized.

It will be appreciated that any suitable biasing device such as coil springs, flexible washers, etc., can be employed in lieu of the cap 90 for applying a sufficiently strong upward bias to the lower container portion 42.

The sleeve upper portion 40 is fixedly mounted to the upper container portion 13 so as to be rotatably immovable relative thereto. In that regard, the inside periphery of the sleeve upper portion 40 includes a plurality of radially inwardly projecting ribs 102 which fit into corresponding slots 104 formed in the upper container portion 13. Also, a circumferentially extending rib 103 mates with a corresponding recess 105 in the upper container portion 13. Accordingly, by immobilizing the sleeve upper portion 40, the upper container portion 13 is also immobilized. The disk 91 can be sonically welded to the sleeve lower portion 42 after being screwed-in by a predetermined distance in order that the fingers 94 apply a selected biasing force to the lower container portion 15.

In use, the dispenser is purchased as depicted in FIG. 1. The energy-storing bellows 82 contains gas in either a compressed or non-compressed state. If the bellows 82 is non-compressed, then the user grasps the sleeve upper portion 40 with one hand and rotates the sleeve lower portion 42 with the other hand. In response to such rotation, the threaded connection 44, 78 between the sleeve lower portion 42 and the piston 70 causes the piston 70 to rise, whereupon the energy-storing bellows 82 is collapsed in order to compress the gas therein. Once compressed, the gas attempts to expand, thereby pressurizing the product within the bag 56. Thus, whenever the valve 54 is opened, the product will be expelled, preferably as a spray. The product will be expelled until the bellows 82 has fully expanded, thereby depleting its stored energy. In order to re-energize the bellows 82, the sleeve lower portion 42 is again rotated.

The toothed connection 32, 34 between the container portions 13, 15 constitutes an overload prevention mechanism which ensures that the bellows 82 and bag 56 will not be excessively compressed. As the bellows 82 is compressed, the resistance to compression increases, whereby the threads 78 of the piston lugs 74 are pressed more firmly against the walls of the thread 44 of the sleeve lower portion 42. Consequently, frictional force is applied from the thread 44 to the threads 78 in a direction tending to produce rotation of the piston. Those forces are transferred to the lower container portion 15 since the lugs 74 extend through the slots 28 of the latter. Rotation of the lower container portion 15 is prevented by the immobilized upper container portion 13 through the tooth connection 32, 34. That is, the inclined faces 33 of the teeth 32 of the lower container portion 15 bear against the inclined faces 35 of the teeth 34 of the upper container portion 13. In so doing, the teeth 34 tend to cam the teeth 32 downwardly, but such downward movement of the teeth 32 is resisted by the upward restoring force applied against the lower container portion 15 by the spring fingers 94.

However, as the bellows 82 becomes excessively compressed, the camming force will overcome the restoring force, causing the teeth 32 to be pushed away from the teeth 34 against the bias of the spring fingers 94. Accordingly, no further compression of the bellows 82 can take place until the bellows 82 has been at least partially de-energized by the discharge of product.

The amount of compression of the bellows 82 which is permitted by the overload prevention mechanism can be regulated by a number of parameters or combination thereof, such as the angles of inclination the tooth faces 33, 35, the inclination of the helical threading 44, 78, and the stiffness of the spring fingers 94.

Once all of the product has been discharged from the bag 56, a product refill assembly can be installed by unscrewing the cap 52 from the collar 22, removing the depleted product assembly 50, and inserting a new product assembly.

Figure 5:
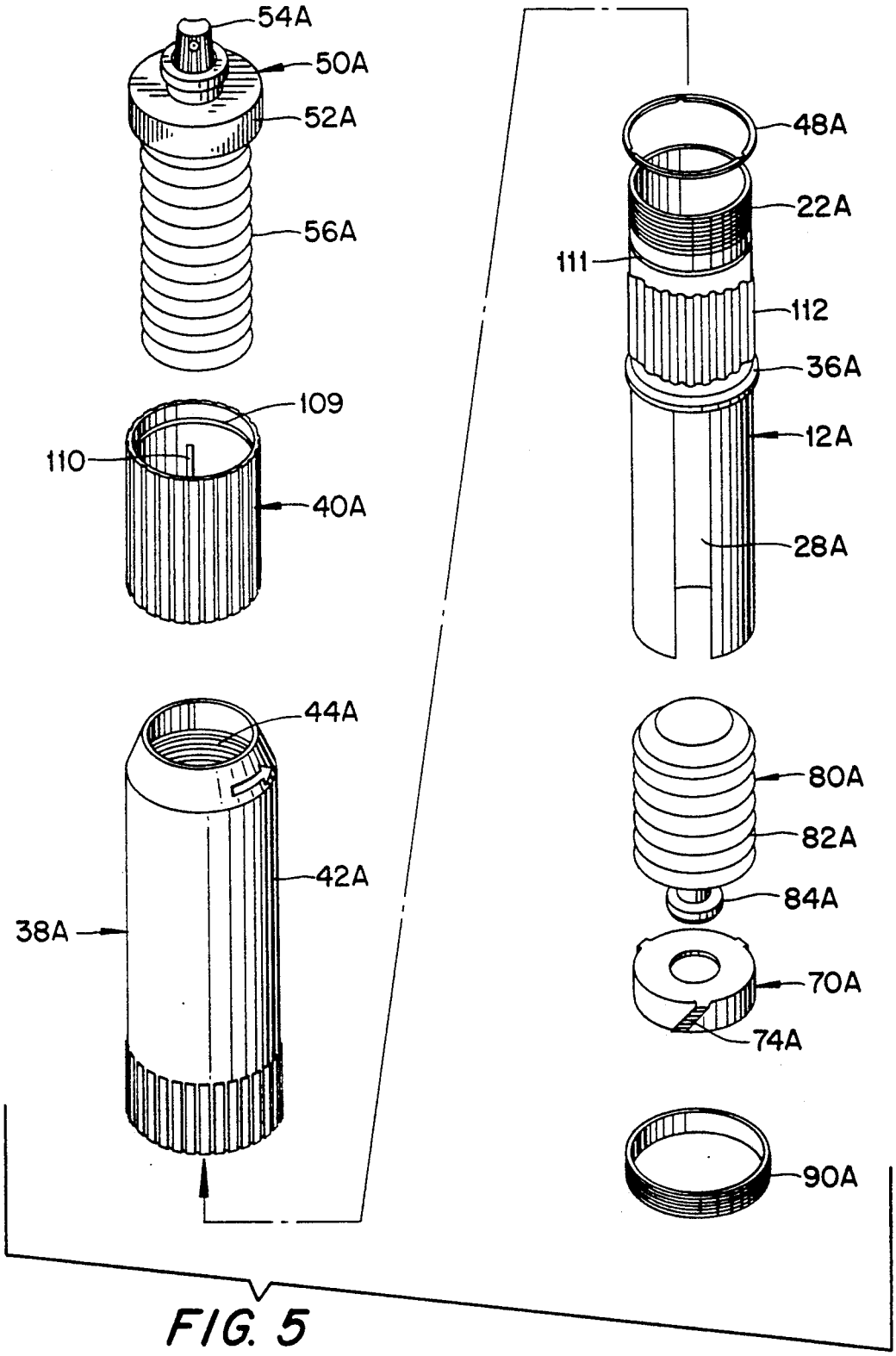
FIG. 5 is an exploded perspective view of a dispenser according to the present invention which comprises the first embodiment of the energy-storing structure, and a second embodiment of an overload prevention mechanism.
Figure 6:
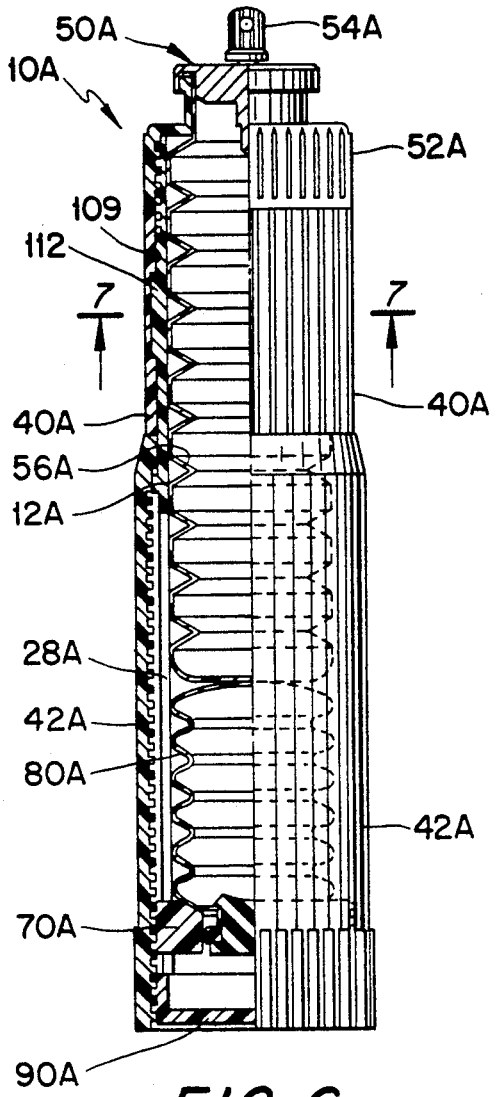
FIG. 6 is a side elevational view of the dispenser depicted in FIG. 5, with the components thereof being in assembled condition, and with the left side of the dispenser being shown in vertical section.
Figure 7:
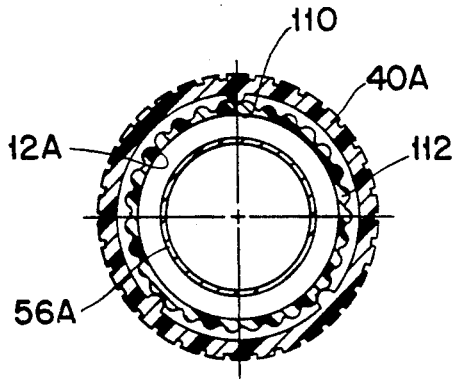
FIG. 7 is a cross-sectional view taken along the line 7—7 in FIG. 6.

A second preferred embodiment of an overload-preventing mechanism is depicted in FIGS. 5-7. The elements of that embodiment which correspond to the elements of the embodiment depicted in FIGS. 1 and 2 are provided with the same reference numerals to which the suffix "A" has been added. In the embodiment of FIGS. 5-7, the container 12A is essentially of one piece. However, the sleeve upper portion 40A is not fixed to the container 12A, but rather is attached thereto by a disengageable coupling. That disengageable coupling comprises a plurality of radially inwardly projecting, longitudinal extending bumps 110 formed on the inner periphery of the sleeve upper portion 40A (see FIG. 7). Those bumps 110 mesh with a plurality of radially outwardly projecting, longitudinally extending bumps 112 formed on the outer periphery of the container 12A. The sleeve upper portion 40A includes a circumferential rib 109 which mates with a corresponding circumferential recess 111 of the container 12A. In use, as the bellows 82A is compressed, producing an increase in the rotation-inducing forces applied to the container from the sleeve lower portion 42A through the thread connection 44A, 78A (as described earlier herein), the container 12A attempts to rotate relative to the sleeve upper portion 40A. That rotation is prevented by the immobilization of the sleeve upper portion 40A. The cylindrical wall of the sleeve upper portion 40A is provided with a certain degree of flexibility which enables the bumps 112 of the container 12A to rotate relative to the bumps 110 of the sleeve upper portion 40A. By regulating the size of the bumps 110, 112 and the flexibility of the sleeve upper portion 40A, a desired amount of permissible loading of the bellows 82 can be determined.

Figure 3:
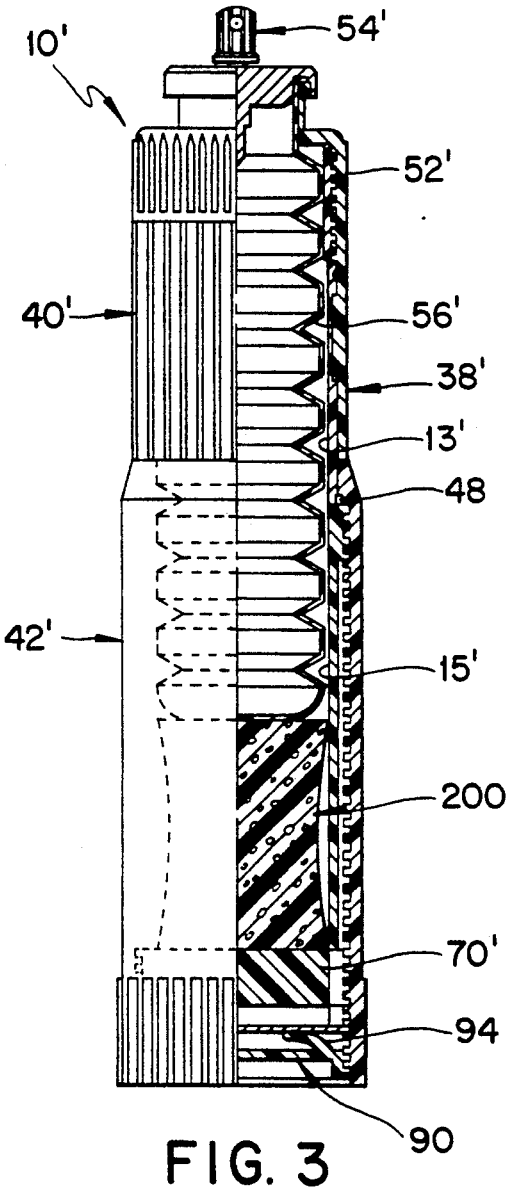
FIG. 3 is a view similar to FIG. 2 depicting a second embodiment of the energy-storing structure.
Figure 4:
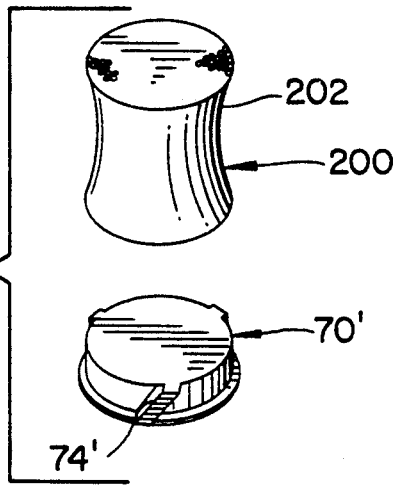
FIG. 4 is an exploded perspective view of the energy-storing structure and piston employed in the embodiment according to FIG. 3.

A second embodiment of the energy storing mechanism is depicted in FIGS. 3 and 4 in combination with the overload prevention mechanism depicted in FIGS. 1 and 2. The elements of FIGS. 3 and 4 which correspond to those of FIGS. 1 and 2 are provided with the same reference numerals to which a prime (') symbol has been added.

In lieu of employing an energy storing device in the form of a gas-filled bellows, the embodiment depicted in FIGS. 3 and 4 envisions the use of a closed-cell plastic foam element 200 wherein at least a substantial majority of the cells thereof are closed. Foams of that type are characterized by a multitude of tiny, gas-filled, closed cells encased within a plastic matrix or bonding agent, such as urethane for example. When the foam is compressed, the gas-filled cells are collapsed, thereby storing energy to pressurize the product bag 56A' which rests directly on the foam element. As the product is discharged, the cells expand, thereby dissipating the stored energy. One type of such foam which has been found acceptable is that manufactured and sold by Freudenberg-NOK of Plymouth, Mich. under the designation AUZ 2500. The closed-cell foam behaves like an elastomer and has very low compression set. Since the gas cells are collapsed when the foam is compressed, there occurs little lateral bulging of the element. By providing the foam element 200 in a generally cylindrical form with an appropriately sized concavely shaped side wall 202, as depicted in FIG. 4, any lateral (radial) bulging which occurs during compression will not increase the diameter of the element beyond its original maximum diameter. Accordingly, there is no need to provide an appreciable radial gap between the foam element 200 and the inner surface of the container 12'.

The gas disposed within the closed cells of the foam is permanently trapped therein, so the foam element avoids altogether the problems of gas migration or leakage.

By varying the size of the foam cells and the type of matrix material, the density and stiffness of the foam element can be changed. By selecting a suitable density and stiffness, as well as a suitable height of the foam element, the foam element can be tailored to properly pressurize liquid products of a wide variety of viscosities, in order to achieve suitable discharge flow volumes of the products.

Figure 8:
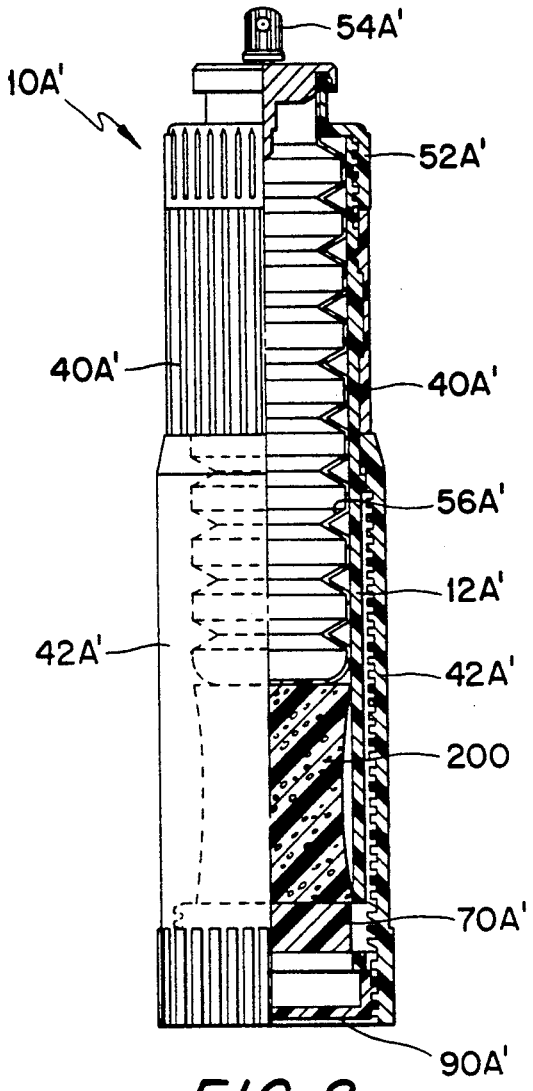
FIG. 8 is a view similar to FIG. 6, which employs the second embodiment of the energy-storing structure and the second embodiment of the overload prevention mechanism.

Depicted in FIG. 8 is the use of a closed-cell foam element 200' in a dispenser having an overload preventing mechanism of the type depicted in FIGS. 5–7. The elements of that dispenser which correspond to the elements of FIGS. 5–7 have the same numerals provided with a prime (') symbol.

It will be appreciated that the present invention provides a dispenser capable of pressurizing a liquid product with a substantially constant pressure of selected magnitude, and to continuously apply that pressure for an ample duration in order to achieve a suitable spray pattern for most types of liquid products. This is accomplished without the discharge of polluting propellant gases. The use of a closed cell foam enables pressurized gas to be used with no risk of compression set or loss of gas pressure. Hence, an acceptable shelf life of the dispenser is ensured. Since the foam element exhibits little lateral bulging when compressed (as compared for example to a solid elastomeric body), the foam element can be used in a confined (compact) space. By properly shaping the side(s) of the foam element, it can be ensured that the foam element will not expand laterally beyond its original maximum diameter. By a proper selection of cell size, matrix material, and foam element height, the product-energizing characteristics of the foam can be adapted to products of different viscosities.

Moreover, the overload preventing mechanism ensures that the energy-storing member will not be excessively compressed.

In addition, the product container/valve unit of an empty dispenser can be replaced by a refill unit, so the only items which must be disposed of are the valve and product container.

Although the present invention has been described in connection with preferred embodiments thereof, it will be appreciated by those skilled in the art that additions, modifications, substitutions, and deletions not specifically described may be made without departing from the spirit and scope of the invention as defined in the appended claims.

What is claimed is:

1. A dispenser comprising a housing; a manually operable outlet valve at a longitudinal upper end of said housing; a flexible product-containing member disposed beneath said valve such that an interior of said product-containing member communicates with said valve; an elastically flexible energy-storing member disposed beneath said product-containing member; a portion of said housing being manually rotatable; and an energizing member disposed beneath said energy-storing member and operably connected with said rotatable portion of said housing to be raised in response to rotation of said rotatable portion for compressing said energy-storing member and pressurizing said product-containing member; said energy-storing member being expandable to expel product from said product-containing member when said valve is open, and being recompressible by said manually rotatable portion; said energy storing member comprising a closed-cell foam element.

2. A dispenser according to claim 1, wherein said closed-cell foam element comprises a closed-cell urethane foam element.

3. A dispenser according to claim 1, wherein said closed-cell foam element is of generally cylindrical shape.

4. A dispenser according to claim 3, wherein a side wall of said closed-cell foam element is slightly concave.

5. A dispenser according to claim I, wherein a bottom of said flexible product-containing member rests upon an upper surface of said closed-cell foam element.

6. A dispenser according to claim 1 including overload preventing means for preventing said energizing member from being raised after said energy storing member has been compressed by a predetermined amount.

7. A dispenser according to claim 6, wherein said housing comprises upper and lower cylindrical sleeve members, said lower sleeve member forming said rotatable portion and being rotatable relative to said upper sleeve member; a cylindrical container provided in said housing; said product-containing member, said closed-cell foam member, and said energizing member being disposed in said container; said energizing member comprising a piston having radial lugs extending through vertical slots formed in said container; said lugs being threadedly coupled to said lower sleeve member so as to be vertically raised in response to rotation of said lower sleeve member.

8. A dispenser according to claim 7, wherein said container comprises separate upper and lower portions; said overload prevention means comprising a releasable connection between said upper and lower container portions.

9. A dispenser according to claim 8, wherein said releasable connection comprises intermeshing teeth on said upper and lower container portions.

10. A dispenser according to claim 9, wherein said upper container portion is fixed to said upper sleeve member; spring means yieldably biasing said lower container portion upwardly against said upper container portion to mesh said teeth together; said teeth of said upper container portion camming said teeth of said lower container portion downwardly against the bias of said spring means when said closed-cell foam element has been compressed by a predetermined amount.

11. A dispenser according to claim 10 including a lower cap connected within a lower end of said lower sleeve member, said spring means being carried by said lower cap.

12. A dispenser according to claim 11, wherein said spring means comprises fingers joined as one piece with said lower cap.

13. A dispenser according to claim 7, wherein said overload prevention means comprises a releasable connection between said container and said upper sleeve member.

14. A dispenser according to claim 13, wherein said upper sleeve member includes radially inwardly projecting outer bumps meshing with radially outwardly projecting inner bumps on said container; said upper sleeve member being flexible so that said inner bumps cam said outer bumps outwardly to disengage said outer and inner bumps when said closed-cell foam element has been compressed by a predetermined amount.

15. A dispenser according to claim 1, wherein said valve and said product-containing member are removable as a unit from said housing.

16. A dispenser according to claim 1, wherein said valve is connected to a top cap which is threadedly connected to said upper sleeve member; said product-containing member being connected to said top cap such that said top cap, said valve, and said product-containing member are removable as a unit from said housing upon unthreading said top cap.

17. A dispenser comprising a housing; a manually operable outlet valve at a longitudinal upper end of said housing; a flexible product-containing member disposed beneath said valve such that an interior of said product-containing member communicates with said valve; an elastically flexible energy-storing member disposed beneath said product-containing member; a portion of said housing being manually rotatable; and an energizing member disposed beneath said energy-storing member and operably connected with said rotatable portion of said housing to be raised in response to rotation of said rotatable portion for compressing said energy-storing member and pressurizing said product-containing member; said energy-storing member being expandable to expel product from said product-containing member when said valve is open, and being repeatedly recompressible by said manually rotatable portion; and overload preventing means for preventing said energizing member from being raised after said energy-storing member has been compressed by a predetermined amount.

18. A dispenser according to claim 17, wherein said housing comprises upper and lower cylindrical sleeve members, said lower sleeve member forming said rotatable portion and being rotatable relative to said upper sleeve member; a cylindrical container provided in said housing; said product-containing member, said energy storing member, and said energizing member being disposed in said container; said energizing member comprising a piston having radial lugs extending through vertical slots formed in said container; said lugs being threadedly coupled to said lower sleeve member so as to be vertically raised in response to rotation of said lower sleeve member.

19. A dispenser according to claim 18, wherein said container comprises separate upper and lower portions; said overload prevention means comprising a releasable connection between said upper and lower container portions.

20. A dispenser according to claim 19, wherein said releasable connection comprises intermeshing teeth on said upper and lower container portions.

21. A dispenser according to claim 20, wherein said upper container portion is fixed to said upper sleeve member; spring means yieldably biasing said lower container portion upwardly against said upper container portion to mesh said teeth together; said teeth of said upper container portion camming said teeth of said lower container portion downwardly against the bias of said spring means when said energy storing element has been compressed by a predetermined amount.

22. A dispenser according to claim 21 including a lower cap connected within a lower end of said lower sleeve member, said spring means being carried by said lower cap.

23. A dispenser according to claim 18, wherein said overload prevention means comprises a releasable connection between said container and said upper sleeve member.

24. A dispenser according to claim 23, wherein said upper sleeve member includes radially inwardly projecting outer bumps meshing with radially outwardly projecting inner bumps on said container; said upper sleeve member being flexible so that said inner bumps cam said outer bumps outwardly to disengage said outer and inner bumps when said energy storing element has been compressed by a predetermined amount.

25. A dispenser comprising a housing defining a vertical longitudinal center axis and having a container therein with a first screw thread at a longitudinal upper end thereof; a top cap comprising a lower portion having a second screw thread at a lower end thereof threadedly connected to said first screw thread, an upper portion of said top cap fixedly attached to an outer peripheral edge of an upper end of said lower portion, and a manually operable outlet valve mounted on an upper surface of said upper portion; a flexible product-containing bag having an upper peripheral edge sandwiched between a lower end of said upper portion and said upper end of said lower portion such that said upper peripheral edge forms a permanently open upper opening of said product-containing bag, said opening being coaxially arranged with respect to said longitudinal axis; an interior of said product-containing bag being in communication with said valve through said opening; an elastically flexible energy-storing member disposed beneath said product-containing bag; a portion of said housing being manually rotatable; and an energizing member disposed beneath said energy-storing member and operably connected with said rotatable portion of said housing to be raised in response to rotation of said rotatable portion for compressing said energy-storing member and pressurizing said product-containing bag; said energy-storing member being expandable to expel product from said product-containing bag when said valve is open, and being repeatedly recompressible by said manually rotatable member; said top cap and said product-containing bag being removable as a unit from said housing to enable a refill unit comprised of said top cap and said product-containing bag to be installed.

* * * * *